United States Patent [19]

Maul et al.

[11] Patent Number: 4,690,394

[45] Date of Patent: Sep. 1, 1987

[54] STACK STOP ASSEMBLY ON A SHEET FEEDER OF A PRINTING PRESS

[75] Inventors: Bernhard Maul, Heidelberg; Günter Zobl, Leimen; Hans-Jürgen Kusch, Neckargemünd, all of Fed. Rep. of Germany

[73] Assignee: Heidelberger Druckmaschinen AG, Heidelberg, Fed. Rep. of Germany

[21] Appl. No.: 707,096

[22] Filed: Mar. 1, 1985

[30] Foreign Application Priority Data

Mar. 1, 1984 [DE] Fed. Rep. of Germany ... 8406329[U]

[51] Int. Cl.[4] ..... B65H 5/10

[52] U.S. Cl. ..... 271/11; 271/98; 271/104; 271/107; 271/167

[58] Field of Search ..... 271/11, 12, 13, 14, 271/15, 30.1, 98, 97, 104, 105, 107, 162, 164, 167, 169, 170, 171, 247, 127

[56] References Cited

U.S. PATENT DOCUMENTS 1,898,535 2/1933 Haupt et al. ..... 271/14 X
3,539,178 2/1968 Yanagawa ..... 271/170 X
4,148,474 4/1979 Back ..... 271/170

FOREIGN PATENT DOCUMENTS 0465866 5/1937 United Kingdom ..... 271/104

*Primary Examiner*—Richard A. Schacher
*Attorney, Agent, or Firm*—Herbert L. Lerner; Laurence A. Greenberg

[57] ABSTRACT

A stack stop assembly is on a sheet feeder of a printing press having an impression cylinder with grippers disposed thereon formed with respective sheet stops. A row of suckers and a pair of conveyor rollers are disposed between the sheet feeder and the impression cylinder. An uppermost sheet of a stack of sheets is liftable at a leading edge thereof by the row of suckers over and beyond stack stops of the stack stop assembly and being feedable to the pair of conveyor rollers for advancing the uppermost sheet to the sheet stops formed on the impression-cylinder grippers. The stack stop assembly includes swivel bearings supporting the stack stops, respectively, at both sides thereof, each of the stack stops having a journal pin to which a pivot arm is secured.

4 Claims, 2 Drawing Figures

STACK STOP ASSEMBLY ON A SHEET FEEDER OF A PRINTING PRESS

Figure 1:
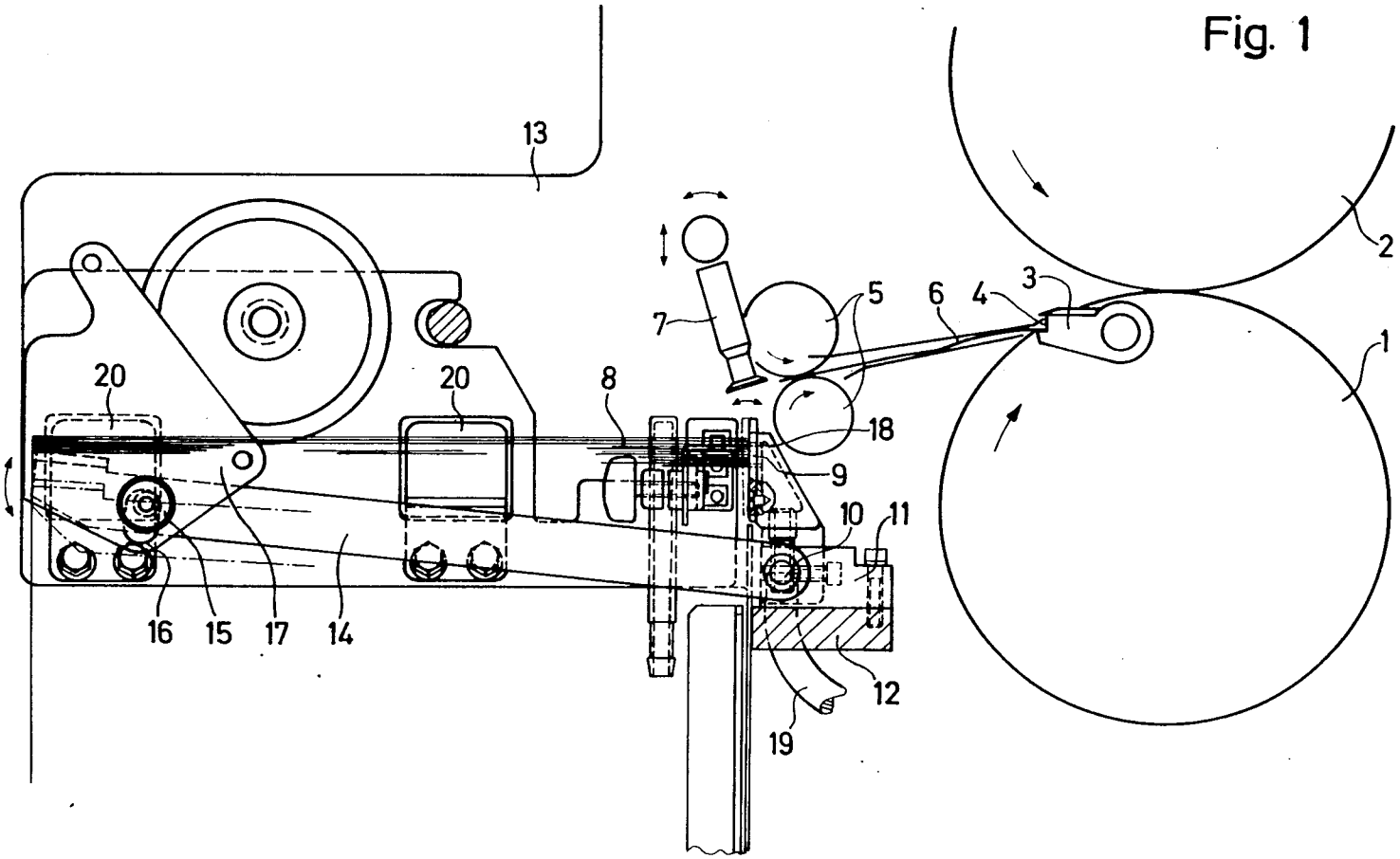

The invention relates to a stack stop assembly on a sheet feeder of a printing press and more particularly to such a printing press having an impression cylinder with grippers disposed thereon formed with respective sheet stops and having a row of suckers and a pair of conveyor rollers disposed between the sheet feeder and the impression cylinder, an uppermost sheet of a stack of sheets being liftable at a leading edge thereof by the row of suckers over and beyond stack stops of the stack stop assembly and being feedable to the pair of conveyor rollers for advancing the uppermost sheet to the sheet stops formed on the impression-cylinder grippers.

In order to achieve accurately positioned or in-register printing and reliable travel in the processing of paper sheets in printing presses, it is necessary, prior to the printing, to guide the sheet against stops both in the direction of travel and laterally and thereby orient the sheet. To this effect a stack stop is provided at the front side of the paper stack facing towards the processing machine, the uppermost layers especially of the paper stack being oriented by the stack stop.

The uppermost paper sheet is removed from the stacking installation by means of a swivellable sucker system and fed to a pair of conveyor rollers having a constant circumferential speed greater than the circumferential speed of the impression cylinder and which accordingly advance the sheet to bulge against the slower advancing paper stop of the impression cylinder. The paper stop may, in this connection, be provided in the gripper system of the impression cylinder. When the sheet rests against the paper stop with a slight bulge and is securely held by the grippers, the conveyor rollers end the conveyance or advancement of the sheet. To this end, the conveyor rollers are separated from one another under the control of a cam.

In the processing of different qualities of paper, unwanted great bulging may occur, especially in the case of relatively thicker papers, which leads to loud noises and damage to the leading edge of the paper due to the stop on the impression cylinder. When such thicker paper is fed to the conveyor rollers by the sucker system, it is engaged earlier than thinner sheets, so that it strikes the stop on the impression cylinder harder, causing greater noise. Also, at the end of the feed or conveying operation, when the conveyor rollers separate, the thicker paper has been conveyed for a longer period of time and hence over a greater distance than the thinner paper.

This inevitable phenomenon is accompanied by other factors such as differences in the suction and release of the sheets by the sucker system, transfer to the conveyor rollers and slippage between the conveyor rollers, such factors being capable even more of intensifying the different feed times or conveyance periods. All of these phenomena can lead to an intensification of the noise i.e. the so-called snap or crackle of the paper.

It is accordingly an object of the invention, using relatively simple means, to provide a sheet feeder with a stack stop assembly whereby travel between the stack stop of the paper stack and the stop on the impression-cylinder gripper is varied in such a manner that the feed or conveying distance and, accordingly, also the bulging on the sheet can be optimally adjusted for every quality and thickness of paper.

It is a further object of the invention to provide such a stack stop assembly as will produce an easy-to-operate sheet feeder answering to the practical requirements especially of small printing presses.

With the foregoing and other objects in view, there is thus provided, in accordance with the invention, a stack stop assembly on a sheet feeder of a printing press having an impression cylinder with grippers disposed thereon formed with respective sheet stops and having a row of suckers and a pair of conveyor rollers disposed between the sheet feeder and the impression cylinder, an uppermost sheet of a stack of sheets being liftable at a leading edge thereof by the row of suckers over and beyond stack stops of the stack stop assembly and being feedable to the pair of conveyor rollers for advancing the uppermost sheet to the sheet stops formed on the impression-cylinder grippers, the stack stop assembly comprising swivel bearings supporting the stack stops, respectively, at both sides thereof, each of the stack stops having a journal pin to which a pivot arm is secured.

The position of the stack stop being thus able to be varied by relatively simple actuation of the pivot arm so that optimal presentation of the sheet and, accordingly, also reliable conveyance of the sheet by the grippers is assured with a minimum of noise.

In accordance with another feature of the invention, the pivot arm extends laterally of the stack of sheets to the rear end thereof and, via a brake pir, extends in a slot formed in a plate secured to a lateral frame of the printing press so that the respective stack stop is swingable towards the stack of sheets.

In accordance with an added feature of the invention, the respective stack stop is formed as a hollow body, is formed with blow openings in vicinity of an upper edge of the stack of sheets and is connected via a supply line to a supply of compressed air.

In accordance with a concomitant feature of the invention, there is provided a device which includes a frame crossmember to which the swivel bearings are secured.

Other features which are considered as characteristic for the invention are set forth in the appended claims.

Although the invention is illustrated and described herein as embodied in a stack stop assembly on a sheet feeder of a printing press, it is nevertheless not intended to be limited to the details shown, since various modifications and structural changes may be made therein without departing from the spirit of the invention and within the scope and range of equivalents of the claims.

Figure 2:
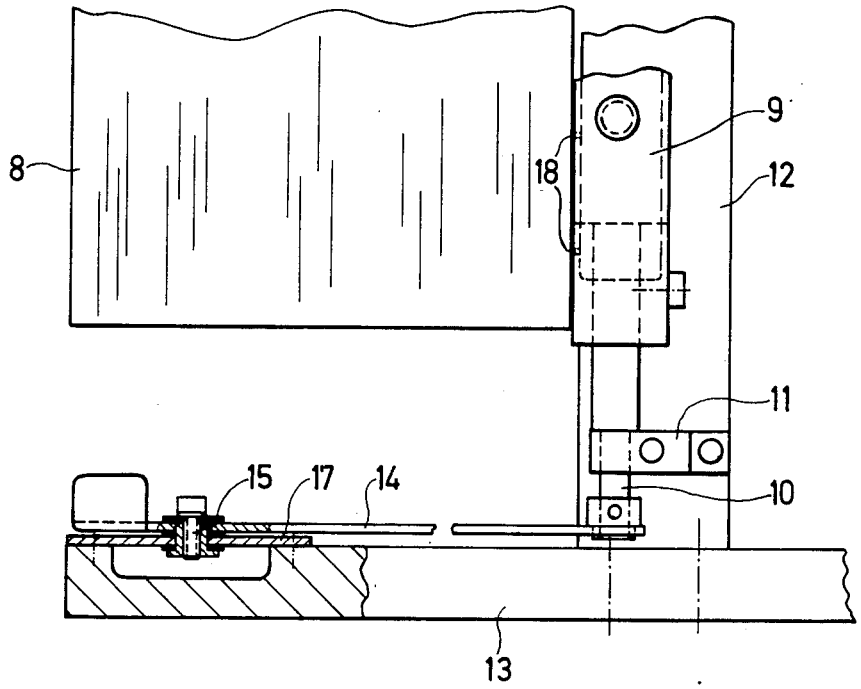

The construction and method of operation of the invention, however, together with additional objects and advantages thereof will be best understood from the following description of specific embodiments when read in connection with the accompanying drawings, in which:

FIG. 1 is a diagrammatic side elevational view of a stack installation embodying the stack stop assembly according to the invention; and FIG. 2 is a fragmentary top plan view of FIG. 1.

Referring now to the drawing and first, particularly, to FIG. 1 thereof, there is shown part of a conventional offset printing unit having an impression cylinder 1 and a rubber or blanket cylinder 2, which cooperates with a non-illustrated plate cylinder with which, again in a conventional manner, an inking-dampening unit is associated. The impression cylinder 1 is provided with grippers 3 for transporting sheets, the grippers 3 being provided with sheet stops 4. A conveyor roller pair 5 transports the fed sheets 6 up to the sheet stop 4 at a speed slightly higher than the circumferential speed of the impression cylinder 1. Once the sheet has slightly bulged and is reliably or securely held by the grippers 3, disengagement of the individual rollers of the conveyor roller pair 5 occurs via a non-illustrated conventional control device.

The paper sheets which are to be fed to the printing unit are removed from a sheet stack 8 by a swivellable sucker system 7 and fed to a conveyor roller pair 5. Especially for relatively small sheet sizes or formats, a stack stop 9, against which the sheets come to rest, is sufficient for orienting the sheets in the travel direction thereof. The upper edge of the sheet stack 8 is always maintained at approximately the same height by a non-illustrated conventional stack raising device.

Stack stops 9 are mounted on both sides thereof in swivel bearings 11 via journal pins 10, the swivel bearings 11 being in turn secured to a frame cross-member 12 which is arranged between two side frames 13 of the printing press and bolted to those side frames 13.

A swivel or pivot arm 14 is secured to a journal pin 10 of the stack stop 9, the pivot arm 14 extending laterally of the sheet stack to the rear end thereof and being guided by means of a brake pin 15 in a slot 16 which is formed in a plate 17 secured to the side frame 13. Via the swivel or pivot arm 14, the stack stop 9 is thus able to swivel or pivot up to the stop in the travel direction of the paper sheets, the travel between the leading edge of the paper sheets in the installation at the stack stop 9 and the sheet stop 4 on the impression cylinder 1 being steplessly variable, resulting in different extents of paper-bulging. The inclined position of the stack stop 9 in the direction of the sheet stack 8 ensures that the sheets of paper are always pressed against the stack stop 9 as the level of the table rises.

In the illustrated embodiment, the stack stop 9 is formed as a hollow body having blower openings 18 in vicinity of the upper edge of the stack which are connected to a non-illustrated conventional compressed-air supply via a supply line 19. The blower openings 18 at the stack stop 9 serve to fan or fluff out the sheets of paper in the presentation or engaging position in order to facilitate the lifting off of the respective uppermost sheet for feeding the sheet into the press. Stops 20 are provided for lateral alignment of the sheet stack.

FIG. 2 is a plan view especially of the sheet stop 9 with the swivel or pivot arm 14, the side guides 20 (FIG. 1) for the sheet stack 8 being omitted from FIG. 2 in the interest of clarity.

The foregoing is a description corresponding in substance to German Application No. G 84 06 329.7, dated Mar. 1, 1984, the International priority of which is being claimed for the instant application, and which is hereby made part of this application. Any material discrepancies between the foregoing specification and the aforementioned corresponding German application are to be resolved in favor of the latter.

We claim:

1. Stack stop assembly on a sheet feeder of a printing press having an impression cylinder, with grippers disposed thereon formed with respective sheet stops, and having a row of suckers and a pair of conveyor rollers disposed between the sheet feeder and the impression cylinder, an uppermost sheet of a stack of sheets being liftable at a leading edge thereof by the row of suckers over and beyond stack stops of the stack stop assembly and being feedable to the pair of conveyor rollers for advancing the uppermost sheet to the sheet stops formed on the impression-cylinder grippers, the stack stop assembly comprising swivel bearings supporting the stack stops, respectively, at both sides thereof, each of the stack stops having a journal pin to which a pivot arm is secured, said stack stops being pivotable on said journal pins, during press operation so as to vary the direction of transport of the uppermost sheet, and being fixed against reciprocal motion with respect to the stack stop assembly.

2. Stack stop assembly according to claim 1 wherein said pivot arm extends laterally of the stack of sheets to the rear end thereof and, via a brake pin, extends in a slot formed in a plate secured to a side frame of the printing press so that the respective stack stop is pivotable towards the stack of sheets.

3. Stack stop assembly according to claim 1 including a frame cross-member to which said swivel bearings are secured.

4. Stack stop assembly on a sheet feeder of a printing press having an impression cylinder, with grippers disposed thereon formed with respective sheet stops, and having a row of suckers and a pair of conveyor rollers disposed between the sheet feeder and the impression cylinder, an uppermost sheet of a stack of sheets being liftable at a leading edge thereof by the row of suckers over and beyond stack stops of the stack stop assembly and being feedable to the pair of conveyor rollers for advancing the uppermost sheet to the sheet stops formed on the impression-cylinder grippers, the stack stop assembly comprising swivel bearings supporting the stack stops, respectively, at both sides thereof, each of the stack stops having a journal pin to which a pivot arm is secured, the respective stack stop being formed as a hollow body, being formed with blow openings in vicinity of an upper edge of the stack of sheets and being connected via a supply line to a supply of compressed air.

* * * * *